United States Patent [19]

Bailleux et al.

[11] Patent Number: 4,770,798

[45] Date of Patent: Sep. 13, 1988

[54] LUBRICATING AND ANTI-CORROSION COMPOSITIONS

[75] Inventors: Jean M. A. Bailleux, Brussels; Ghislain E. E. Hostier, Montignies-sur-Roc, both of Belgium

[73] Assignee: Labofina, S.A., Brussels, Belgium

[21] Appl. No.: 722,571

[22] Filed: Apr. 11, 1985

[30] Foreign Application Priority Data

Apr. 13, 1984 [LU] Luxembourg ..... 85305

[51] Int. Cl.[4] ..... C10M 135/10

[52] U.S. Cl. ..... 252/33.2; 252/33; 252/38; 252/39

[58] Field of Search ..... 252/33.2

[56] References Cited

U.S. PATENT DOCUMENTS

| | | | |
|---|---|---|---|
| 3,080,322 | 3/1963 | Holzinger | 252/33.2 |
| 3,125,521 | 3/1964 | Detweiler | 252/33.2 |
| 3,346,494 | 10/1967 | Robbins | 252/33.2 |
| 3,684,726 | 8/1972 | Haak et al. | 252/33.2 |
| 3,951,829 | 4/1976 | Mullen et al. | 252/325 |
| 4,212,750 | 7/1980 | Gorman | 252/33.2 |

FOREIGN PATENT DOCUMENTS

| | | | |
|---|---|---|---|
| 0001318 | 4/1979 | European Pat. Off. | 252/33.2 |
| 552410 | 1/1958 | Canada | 252/33.2 |
| 624074 | 7/1961 | Canada | 252/33.2 |

*Primary Examiner*—William R. Dixon, Jr.
*Assistant Examiner*—Ellen McAvoy
*Attorney, Agent, or Firm*—John K. Abokhair; Mark A. Montgomery; M. Norwood Cheairs

[57] ABSTRACT

Compositions for treating metal, e.g., steel sheets which act as compositions lubricants during stamping of the sheets and protect the sheets against rust during their storage and before and after the stamping thereof.

The compositions comprise a mineral oil, a basic calcium salt of arylaromatic sulphonic acid, a further anti-rust agent, a saturated higher fatty acid, a non-ionic wetting agent and an anti-oxidizing phenolic compound.

9 Claims, No Drawings

LUBRICATING AND ANTI-CORROSION COMPOSITIONS

FIELD OF THE INVENTION

This invention relates to compositions which are used for treating metal sheets, for example, steel sheets. The invention relates more particularly to coating compositions which protect metal sheets against the formation of rust and which act as lubricants during the shaping of the sheets, for example, by stamping.

BACKGROUND OF THE INVENTION

Steel sheets and other metal sheets which are subject to oxidation have to be protected against corrosion when stored either as wound coils or as uncoiled or cut sheets. Moreover, steel sheets are generally shaped by the user, for instance by stamping, and lubricating compositions are employed for the purpose of facilitating this shaping of the sheets.

Anti-corrosion compositions which are applied on the steel sheets to prevent corrosion during storage are known. Before being shaped by a stamping process, it is necessary to treat steel sheets with lubricating compositions. The application of different coatings at different stages is expensive and requires additional man power.

Proposals for obviating this drawback have been made, and the use of compositions which act both as anti-corrosion agents and as lubricating compounds have already been proposed. However, most of these known compositions exhibit a poor lubricating performance or produce stains on the treated sheets. For instance, the use of compositions containing soaps or unsaturated higher fatty acids, such as oleic acid, result in the formation of stains on the steel sheets. Other compositions, containing mineral oils, also have this drawback or are poor lubricants. The use of compositions containing polybutenes or similar polymers instead of mineral oils has been suggested, but these compositions do not meet the requirements which are presently required for the treatment of steel sheets. In particular, these compositions do not allow high production rates. Acceptable compositions must possess certain characteristics which are now required by the industry. The composition must be sufficiently fluid to be rapidly applied on the steel sheets. Moreover, the composition should be easily removable from the stamped sheets, after the sheets have been processed. Furthermore, some industries, such as the automotive industry, require that the compositions remain stable during thermal treatments of the coated steel sheets where the temperature may reach 140° C. or higher.

There is thus a need for anti-corrosion and lubricating compositions which meet certain specific and stringent requirements. More particularly, the compositions must:

(a) confer an efficient protection against rust formation, during storage of metal steel both as coils or as unwound and stamped sheets;

(b) must possess a lubricating action in order to facilitate the stamping of the sheets;

(c) must remain stable at temperatures of about 140° C. or higher; and (d) must be capable of being removed easily and completely from the sheets by usual solvents or alkaline solutions.

Additionally, the anti-corrosion/lubricants compositions must be easily applied, non-toxic and inexpensive.

The present invention aims to provide compositions which meet these requirements and possess these characteristics.

SUMMARY OF THE INVENTION

Accordingly, the present invention provides anti-corrosion and lubricating compositions for application on metal sheets which compositions comprise a blend of:

(a) a mixture A containing from 65 to 95 weight % of a mineral oil having a viscosity in the range of $15\times10^{-6}$ to $30\times10^{-6}$ $m^2$/ sec at 40° C., and from 5 to 35 weight % of a basic calcium salt of an alkylaryl-sulphonic acid in admixture with another anti-corrosive compounds selected from the group consisting of a petrolatum oxidate, a calcium salt of petrolatum oxidate and a calcium salt of mahogany sulphonic acid; and (b) a mixture B, in an amount of 0.75 to 5 weight % based on the mixture A, said mixture B containing a saturated higher fatty acid having from 12 to 18 carbon atoms, a saturated non-ionic surface-active compound and a heat stable; anti-oxidizing phenolic compound.

DETAILED DESCRIPTION OF THE PREFERRED EMBODIMENTS

The main component of the liquid compositions of the present invention is a mineral oil which, for toxicity reasons, has a low aromatic content. Preferred mineral oils are naphthenic or paraffinic oils which have a viscosity in the range of from about $15\times10^{-6}$ to about $30\times10^{-6}$ $m^2$/sec, more particularly from about $18\times10^{-6}$ to about $25\times10^{-6}$ $m^2$/sec, at 40° C. The amount of mineral oil in the mixture A may vary from about 95 to about 65 weight % and preferably from about 90 to about 75 weight %.

The rest of the mixture A comprises a basic calcium salt of an alkylarylsulphonic acid acting as a rust-preventing compound. The corresponding barium salts are also rust-preventing compounds, but their use is now prohibited in many countries for toxicity reasons. Other salts, such as alkaline and magnesium salts are less efficient and some of these form stains on the treated steel sheets. Calcium salts of alkylarylsulphonic acids are therefore preferably used. These preferred acids have the general formula $R_nAr\ SO_3H$, wherein Ar is an aryl radical, such as benzene, naphthalene, anthracene, R is a straight or branched aliphatic hydrocarbon radical having generally from 7 to 12 carbon atoms and n is 2 or 3. The selection of the sulphonic acid depends on its price and on the effectiveness of its calcium salt with respect to its anti-corrosion properties. Calcium salts of dialkylnaphthalenesulphonic acids, such as dinonylnaphthalene sulphonic acid, are advantageously employed. The calcium salt is a basic salt. This basicity is determined by titration and is expressed by the number of milligrams of KOH which would be required for neutralizing the amount of acid which has been used for the neutralization of the calcium salt (method ASTM D.664). In the compositions of this invention, the calcium salts have a basicity which may vary between wide limits and may reach 300, but which is generally from 10 to 60.

The calcium salt of alkylarylsulphonic acid is employed in admixture with another anti-corrosion compound which may be a petrolatum oxidate, a calcium salt of petrolatum oxidate or a calcium salt of mahogany sulphonic acid.

Micro-crystalline waxes, which are also called petrolatum, may be oxidized and the obtained oxidates, as well as their calcium salts, may be used as rust-preventive compounds Calcium salts of mahogany sulphonic acids are another group of anti-corrosion products. These acids are obtained by reacting petrolatum with a strong sulphonation agent, such as oleum, and they are oleo-soluble. The petrolatum oxidates, their calcium salts and the calcium salts of mahogany sulphonic acids are compatible with the calcium salts of alkylarylsulphonic acids and they improve the anti-corrosion properties of the latter.

The respective amounts of calcium salt of alkylarylsulphonic acid, on one hand, and petrolatum, oxidate, calcium salt of petrolatum oxidate or calcium salt of mahogany sulphonic acid, on the other hand, may vary between wide limits such as from 80:20 to 20:80. For instance, blends of anti-corrosive compounds containing from 50 to 60 weight % of petrolatum oxidate and from 50 to 40 weight % of calcium salt of dinonylnaphthalene sulphonic acid may advantageously be employed.

The compositions of the present invention additionally contain a saturated aliphatic carboxylic acid having from 12 to 18 carbon atoms, such as lauric, myristic, or stearic acid, or a mixture of these acids, such as the fatty acids obtained from coconuts, or soya beans. It has been found that saturated fatty acids are more suitable than unsaturated acids, because the use of the latter results in the formation of stains on the treated sheets. Moreover, the incorporation of saturated fatty acids in the compositions of this invention improves not only the anti-corrosion properties of these compositions but also their lubricating power. Furthermore, at least a part of the saturated fatty acids undergoes a saponification reaction in the compositions of the invention and the resultant soaps facilitate the subsequent removal of the anti-corrosion compositions from the sheets to clean the metal sheets. This cleaning step is improved by incorporating a non-ionic wetting agent or a surfactant in the compositions of the invention. Moreover, the non-ionic wetting agent improves the adhesion of the compositions on the metal sheets. Typical non-ionic agents are the products resulting from the condensation of 1 to 6 groups of ethylene oxide and/or propylene oxide on higher fatty alcohols, alkylphenols or fatty acid esters.

The composition of the present invention comprise also a phenolic anti-oxidant which protects the film obtained by application of these compositions on the metal sheets against the deleterious action of light and against oxidation.

The selection of the phenolic compound depends not only on its price, but also on its thermal stability. Indeed, the metal sheets which have been coated with the protective compositions may be subject to a thermal treatment at temperatures which may reach 140° C. or even higher. After this treatment, the compositions must continue to perform their protective action. Anti-oxidizing agents having the general formula:

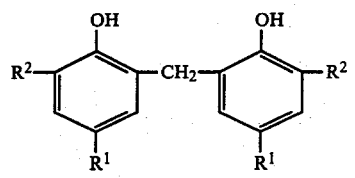

are preferred. In this formula, $R^1$ is H or $CH_3$ and $R^2$ is H or an alkyl radical containing from 1 to 4 carbon atoms. Examples of such anti-oxidizing agents are methylene-bis-phenol, methylene-bis-(4-methyl-6-tert. butylphenol), and mixtures thereof.

The total amount of fatty acid, non-ionic surface active agent and anti-oxidizing phenolic compound (or mixture B) is generally from 0.75 to 5%, based on the weight of mixture A. This mixture B contains a major part of saturated aliphatic monocarboxylic acids, the amount of these acids in mixture B being advantageously in the range of 50 to 75 weight %. Both other components of mixture B are used in substantially equal amounts.

The compositions of the invention meet the above mentioned requirements. These advantageous characteristics results from the synergistic effect of some of the components. For instance, it seems tenable that calcium soaps are produced in situ in these compositions from the fatty acids and/or from the petrolatum oxidate. These calcium soaps improve the lubricating power of the compositions, ensure a better spreading on the metal sheets and make easier the removal of the coating by solvents or alkaline lyes. Moreover, the compositions have a low viscosity and therefore they are easily applied on the metal sheets with formation of an adherent coating. The coils of coated sheets can thereafter be uncoiled and stamped without any rupture or formation of cracks in the coating. This characteristic is particularly important and is obtained when the compositions of the invention are applied not only on steel sheets, but also on zinc-coated sheets, as these compositions are very compatible with zinc.

Although this invention has been described in relation to specific embodiments, modifications may be made by one skilled in the art without departing from the scope of the invention. For instance, the compositions of the invention may also contain a small amount of wax, polyvalent metal phosphate, more particularly a phosphate of a Group IV A metal, further oxidation or light stabilizing agents, or other similar additives.

The following examples further illustrate the present invention and are not intended to limit the present invention.

EXAMPLE 1

A mixture "A" containing:

90 parts by weight naphthenic oil, 10 parts by weight of a mixture of calcium salt of dinonylnaphthalene sulphonic acid (5 parts) and petrolatum oxidate (5 parts was prepared at a temperature of 60° C., while stirring.

A mixture "B" was added to mixture A, said mixture B containing (weight percentages based on the weight of mixture A):

0.3% methylene-bis-(4-methyl-6-tert.butylphenol), 0.3% ethoxylated lauric alcohol (6 group of ethylene oxide)

1.5% melted stearic acid.

The blend of mixtures A and B was an oily, transparent liquid having a density of 0.85 at 20° C., a viscosity of $21\times10^{-6}$ m²/sec at 40° C. and a cloud point of 7° C.

The composition was applied to steel plates and formed a film having a thickness of 3 microns.

The anti-rust property of the protective film was determined by the salt spray test (ASTM B.117; 5% NaCl). Rust began to appear only after 24 hours.

The determination of the lubricating performance of the compositions during stamping tests was carried out in accordance with the Erichsen method (norm DIN 50101) for evaluating the stamping ability of a metal sheet. The tested composition is compared to a standardized reference grease which is a graphite-containing grease defined in this norm DIN 50101. One uses the Erex index which is given by the formula:

$$\text{Erex index} = \frac{pL}{pG} \times 100$$

wherein p L=stamping depth (in millimeters) with the tested composition, and p G=stamping depth (in millimeters with the reference grease.

The Erex index of the composition of this Example was 94.2.

By way of comparison, the following compositions were prepared:

Comparative compositon A:

This composition was similar to the composition of Example 1, but was free from fatty acid.

Rust appeared after 7 hours.

Comparative composition B:

This composition was similar to the composition of Example 1, but was free from phenolic compound and from non-ionic surfactant.

Rust appeared after 12 hours.

Comparative composition C:

This composition was similar to the composition of Example 1, but was free from fatty acid and from non-ionic surfactant.

Rust appeared after 4 hours.

Comparative composition D:

This composition was similar to the composition of Example 1, but an anionic surfactant (sorbitol monooleate) was used instead of the non-ionic surfactant.

Rust appeared after 12 hours.

Comparative composition E:

This composition was similar to the composition of Example 1, but free from petrolatum oxidate.

Rust appeared after 12 hours. Moreover, after removal of the composition, it was observed that the metal sheet was stained.

EXAMPLE 2

A composition was prepared by using a mixture A containing:

90 parts by weight naphthenic oil (viscosity: $20\times10^{-6}$ m²/sec at 40° C.), 5 parts by weight sodium salt of dinonylnaphthalene sulphonic acid, and 5 parts by weight calcium salt of mahogany sulphonic acid.

The mixture B was the same as in Example 1.

The following results were obtained:

rust appeared after 24 hours,

Erex index : 93.8.

EXAMPLE 3

A composition was prepared by blending the following mixtures:

Mixture A: 78 parts by weight mineral oil (viscosity: $22.5\times10^{-6}$ m²/sec at 40° C.), 11 parts by weight calcium salt of dibutylnaphthalene sulphonic acid, 11 parts by weight calcium salt of petroleum oxidate.

Mixture B: (parts by weight based on the weight of mixture A) 0.3 part methylene-bisphenol, 0.5 part ethoxylated higher aliphatic alcohols $C_{12}$–$C_{14}$ (4 groups ethylene oxide), 1.5 parts coconut fatty acid.

The following results were obtained:

rust appeared after 22 hours,

Erex index: 92.4

What is claimed is:

1. An anti-corrosion lubricating composition for metal sheets comprising a blend of:

(a) mixture A containing 65 to 95% by weight of a mineral oil having a viscosity in the range of from about $15\times10^{-6}$ to $30\times10^{-6}$ m²/sec at 40° C., and 5 to 35% by weight of a basic calcium salt of an alkylarylsulphonic acid in admixture with another anti-corrosive compound selected from petrolatum oxidates, calcium salts of petrolatum oxidates and calcium salts of mahogany sulphonic acids; and (b) mixture B, in an amount of from about 0.75 to 5% by weight based on the weight of mixture A, said mixture B containing a saturated higher fatty acid having 12 to 18 carbon atoms, a saturated non-ionic surface-active compound and a heat stable, anti-oxidizing phenolic compound.

2. The composition according to claim 1, wherein mixture A contains from 75 to 90 % of mineral oil.

3. The composition according to claim 1, wherein the mineral oil is a naphthenic or paraffinic oil having a viscosity of from about $18\times10^{-6}$ m²/sec at 40° C.

4. The composition according to claim 1, wherein the basic calcium salt of alkylarylsulphonic acid is the basic calcium salt of an acid having the formula $R_nAr\ SO_3H$ where Ar is an aryl radical, R is the radical of an aliphatic hydrocarbon having from 7 to 12 carbon atoms and n is 2 or 3.

5. The composition according to claim 1, wherein the basic calcium salt has a basicity of from 1 to 300.

6. The composition according to claim 5, wherein the basicity is from 10 to 60.

7. The composition according to claim 1, wherein the weight ratio of the basic calcium salt of alkylarylsulphonic acid in the mixture A to the other components of said mixture A is from 80:20 to 20:80.

8. The composition according to claim 1, wherein the phenolic compound in mixture B has the formula:

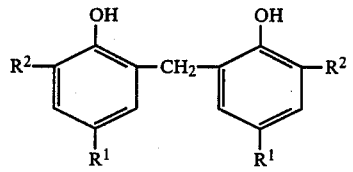

wherein $R^1$ is H or $CH_3$ and $R^2$ is H or an alkyl radical containing from 1 to 4 carbon atoms.

9. The composition according to claim 1, wherein mixture B contains from 50 to 75 weight % saturated, higher fatty acids.

* * * * *